United States Patent [19]

Boes, deceased et al.

[11] Patent Number: 4,950,413

[45] **Date of Patent: * Aug. 21, 1990**

[54] ELECTRICALLY CONDUCTIVE PHTHALOCYANINE COMPLEX-FILLED LUBRICANTS

[75] Inventors: David J. Boes, deceased, late of Monroeville, by Patricia K. Boes, executrix; Mary A. Alvin, Pittsburgh; George R. Kelecava, Youngwood, all of Pa.

[73] Assignee: Westinghouse Electric Corp., Pittsburgh, Pa.

[ * ] Notice: The portion of the term of this patent subsequent to Sep. 6, 2005 has been disclaimed.

[21] Appl. No.: 272,361

[22] Filed: Nov. 17, 1988

[51] Int. Cl.[5] ..... C10M 155/00

[52] U.S. Cl. ..... 252/25; 252/26; 252/11; 252/49.7

[58] Field of Search ..... 252/11, 25, 26, 49.7

[56] References Cited

U.S. PATENT DOCUMENTS

| | | | |
|---|---|---|---|
| 2,597,018 | 5/1952 | Merker et al. . | |
| 2,836,563 | 5/1958 | Dilworth et al. . | |
| 2,929,779 | 3/1960 | Sullivan et al. . | |
| 3,023,164 | 2/1962 | Lawton . | |
| 3,051,721 | 8/1962 | Pfeiffer . | |
| 3,265,617 | 8/1966 | Allen . | |
| 3,432,432 | 3/1969 | Dreher . | |
| 4,769,163 | 9/1988 | Boes et al. | 252/54 |

OTHER PUBLICATIONS

"Electrically-Conductive Group IV A Phthalocyanine Polymers," by Karl Frederick Schoch, Jr., Northwestern University, (Jun. 1982).

"Cofacial Assembly of Partially Oxidized Metallomacrocyclics as an Approach to Controlling Lattice Architecture in Low-Dimensional Molecular Solids, Chemical and Architectural Properties of the 'Face-to-Face' Polymers ([M(Phthalocyanato)O]$_n$) where M=Si,-Ge,Sn," by C. W. Dirk et al., J. Am. Chem. Soc., 105, 1539, (1983).

"The Phthalocyanines, vol. II Manufacture and Applications," by F. H. Moser et al., pp. 53 to 89, CRC Press, Inc., (1983).

"Graphite Lubricant Combinations for High-Temperature Applications," by L. C. Lipp, Lubrication Engineering, vol. 22, No. 25, May (1966), pp. 187-195.

"Friction Properties of Phthalocyanine Pigments," by G. Salomon, Wear, vol. 10, No. 5, pp. 383 to 396, (1967).

*Primary Examiner*—William R. Dixon, Jr.
*Assistant Examiner*—Jerry D. Johnson
*Attorney, Agent, or Firm*—S. R. Bramham

[57] ABSTRACT

A lubricating composition of about 90 to about 99% by weight of a lubricant and about 1 to about 5% by weight of a polymeric organometallic phthalocyanine complex, including nitrogen-substituted analogues thereof, where the complexed metal ion is preferably a Group IVA metal and provides increased time of machine operation to failure by improving grease or oil lubricated bearing performance. The phthalocyanine is doped with an electrically conductive dopant to bleed internal charge build up from the internals of turbines and large drive motors.

12 Claims, No Drawings

ELECTRICALLY CONDUCTIVE PHTHALOCYANINE COMPLEX-FILLED LUBRICANTS

BACKGROUND OF THE INVENTION

In order to increase the life of oil or grease lubricated rotating systems that are operated at high temperatures, high speeds, and/or high loads, various additives and thickeners are sometimes added to the bearing lubricants.

It has been found, for example, that some compounds that have a lattice structure are good additives for lubricants. These include the selenides and sulfides of tungsten, molybdenum, tantalum, and niobium. However, it has also been found that compounds that are chemically similar and that also have a lattice structure have a very poor lubricating ability. For example, tellurium is chemically very similar to selenium, but the tellurides of tungsten, molybdenum, tantalum, and niobium are very poor lubricants. Other compounds that have a lattice structure, such as calcium fluoride, are also poor lubricants at temperatures less than about 600° F. Titanium sulfide, which also has a lattice structure, is actually abrasive. Thus, it is difficult to predict from the chemical structure alone whether or not a compound that has a lattice structure will actually perform well as a lubricant.

During extended use, turbine and drive motor main shaft bearings develop electrical pitting damage due to electrical charge build up. To avoid this pitting damage, the charge has to be physically bled via electrical paths from within the internals of the turbine to the frame.

There remains a need for an electrically conductive lubricant capable of bleeding the charge build up in order to prolong the life of the machinery.

SUMMARY OF THE INVENTION

We have discovered that a polymeric organo-metallic phthalocyanine complex, can be used as an electrically conductive lubricant additive. The resulting lubricant greatly extends the life of turbine or motor bearings, including journal bearings, especially, if they are run at high temperature and/or high speed, or at turning gear speed by doping of the phthalocyanines of the present invention with certain electrically conductive substances.

While the preferred phthalocyanine complexes used in this invention have a lattice structure, it is surprising that they function so well in oils and greases because some of the complexes have silicon-oxygen bonds which might be expected to form through decomposition highly abrasive quartz ($SiO_2$) at high temperatures.

The addition of a reducing or oxidizing dopant to the additive of the present invention provides conductive dissipation as the oil additive bleeds the charge with resulting reductions in pitting and failure.

We have found that synthetic and natural greases and oils incorporating the additives of this invention can increase the life of bearings over ten times, compared to the same grease or oil with no additive being present.

DESCRIPTION OF THE PREFERRED EMBODIMENTS

The additives of this invention are useful with any type of oil or grease, including natural, petroleum-based greases or oils, as well as synthetic lubricants. Synthetic lubricants are preferred, as they can withstand higher temperatures than can petroleum-based greases or oils.

Examples of lubricants that can be used include petroleum based lubricants, perfluoroethers, such as perfluoroalkylethers, diesters, silicones, polyphenylethers, organic grease or oil, including aromatic, chloroalkene and cyclic ethers THF, methanol, acetone, dichloromethane, trichloromethane, benzene, toluene and the like and mixtures thereof The organometallic phthalocyanines of this invention may include any suitable metal M, such as lithium, beryllium, sodium, magnesium, aluminum, silicon, potassium, calcium, scandium, titanium, vanadium, chromium, nickel, copper, chlorinated copper, iron, cobalt, tin, germanium, arsenic, yttrium, zinc, manganese, gallium, zirconium, niobium, molybdenum, technetium, rhenium, rubidium, rhodium, palladium, osmium, iridium, platinum, silver, cadmium, indium, strontium, barium, lanthanum, hafnium, tantalum, tungsten, gold, mercury, tellenium, lead, actinium, protactinium, uranium, neptunium, and the like.

It is preferred that the phthalocyanines be complexes and include nitrogen-substituted analogues of such complexes. These complexes are polymers having the following repeating unit, (including substitutions thereof):

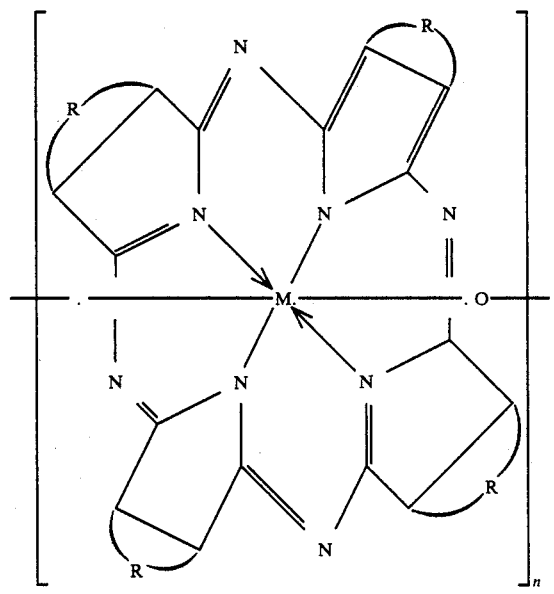

In the above general formula, the polymer chain is perpendicular to the plane of the atoms that form each repeating unit.

Each R group in the formula is a divalent organic group preferably independently selected from

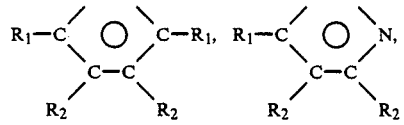

-continued

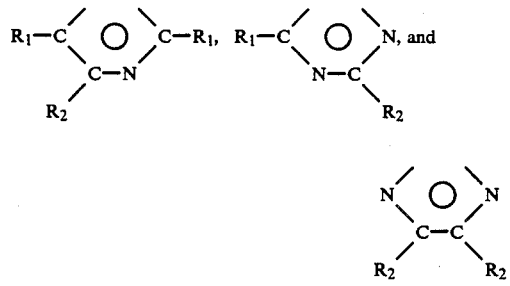

All the R groups form conjugated rings. The R group that contains only carbon atoms in the ring forms a phthalocyanine complex and provides maximum resonance stability to the polymeric complex. The R groups that contain one or two nitrogen atoms in the ring form the nitrogen-substituted analogues.

In the R groups, each peripheral ring substituted $R_1$ or $R_2$, independently, may be either organic or inorganic, and be independently selected from and more particularly may include hydrogen; esters; alkali metals; alkaline metals; sulfates; carboxylates, alcohols; ethers, amines; aromatic compounds such as phenyls, substituted phenyls, phenoxy, cumyl phenoxy, biphenyls; sulfonates; sulfonamides, having a formula $—SO_2NHR_3$, where $R_3$ is independently selected from hydrogen, $C_6H_4SO_3H$, and 2-hydroxy-6-sulfo-1-naphthyl; cyanates; halogenated compounds; aliphatic substituents, including alkyls having carbon length of 1 to 4, t-butyl groups, and alkylenes having carbon length of 1 to 4; linear and branched nitrates; carboxylic acids; cyclic substituents of carbon length of 1 to 10, and the like.

In the general formula the M atom is preferably a Group IVA metal, and more preferably each M is independently selected from silicon, germanium, and tin. The number of repeating units is represented by "n" in the formula; "n" is preferably about 10 to about 200. Preferably, each $R_1$ group, each $R_2$ group, each $R_3$ group, and the metal M in each repeating unit are identical as that simplifies synthesis.

The M group in the formula is most preferably silicon as that compound seems to work well, and $R_1$ and $R_2$ are preferably hydrogen as that compound is easier to make. The preparation of these polymers has been described in the literature. See, for example, Ph.D. thesis by Karl Frederick Schoch, Jr., entitled, "Electrically-Conductive Group IV A Phthalocyanine Polymers," Northwestern University, June, 1982. The polymers as prepared are finely powdered solids.

The undoped phthalocyanine polymers generally have low conductivity, and can be made highly conductive by reaction with suitable oxidizing or reducing dopants. In order to exhibit high conductivity, the polymer should consist of segregated stacks and the suitable dopants should possess capabilities for partial transfer of charge between donors and acceptors. The extent of charge transfer depends, in part, on the difference between the ionization potential of the donor and the electron affinity of the acceptor.

Doping the polymer can be carried out by exposure to dopant vapors, by immersion into doped solutions, or by using the polymer as an electrochemical cell and removing or adding electrons electrochemically. Doped polymer samples are prepared by dissolving a weighed amount of the dopant in a solvent, such as benzene, and stirring with the suspended polymer which had been previously ground in a mortar and pestle. At low dopant concentrations, the supernatant became colorless when the reaction is complete The polymer could also be doped by exposing it in a sealed container to dopant vapor at room temperature or in an oven at 80°–100° C, or else by dissolving the polymer in concentrated $H_2SO_4$ and filtering the solution through a glass frit into an aqueous solution of dopant.

The doping reaction brings about substantial changes in the electronic structure of the polymer, effecting the electrical, optical, and magnetic properties. These properties can be varied over a wide range by controlling the concentration of the dopant in the macrocycle. Although $AsF_5$ doping produces the most conductive phthalocyanine material, other dopants may be used including the oxidizing agents $I_2$, $Br_2$, $H_2SO_4$, HClO, $NOSbF_6$, and $SbF_5$, and the reducing agents Na, K, Li, and $LiAlH_4$.

The preferred method is exposing a quantity of the finely ground polymer to a solution of dopant in an organic solvent because it provided the greatest control over of doping the polymers the exact amount of dopant incorporated. The conductivity is not perceptibly affected by the doping methodology.

The results of conductivity measurements on pressed powder samples of doped $[Si(Pc)O]_n$ and $NiP_c$ are given in Table 1.

TABLE 1

Electrical Conductivity Data For Polycrystalline Samples Of $[Si(Pc)0]_n$ and Ni(Pc) with Various Dopants**

| Dopant | Empirical Formula | $\sigma(\Omega^{-1}\ cm^{-1})$ 300° K. | Activation Energy (eV) Low Temp. | High Temp. |
|---|---|---|---|---|
| undoped | $[Si(Pc)O]_n$ | $8.5 \times 10^{-7}$ | | 0.30 |
| I | $[Si(Pc)O]I_{1.13n}$ | $6.7 \times 10^{-1}$ | 0.009 | 0.028 |
| Br | $[Si(Pc)O]Br_{1.8n}$ | $4.9 \times 10^{-1}$ | 0.020 | 0.039 |
| K | $[Si(Pc)O]K_{1.0n}$ | $2 \times 10^{-5}$ | — | — |
| DDQ | $[Si(Pc)O]DDQ_{0.35n}$ | $6.2 \times 10^{-2}$ | | 0.05 |
| TCNQ | $[Si(Pc)O]TCNQ_{0.44n}$ | $2.3 \times 10^{-3}$ | 0.078 | 0.12 |
| ClA | $[Si(Pc)O]ClA_{0.14n}$ | $1.8 \times 10^{-3}$ | | 0.14 |
| Flr | $[Si(Pc)O]Flr_{0.23n}$ | $7.2 \times 10^{-4}$ | | 0.13 |
| Chl | $[Si(Pc)O]Chl_{0.22n}$ | $6.9 \times 10^{-4}$ | | 0.13 |
| Brl | $[Si(Pc)O]Brl_{0.84n}$ | $5.8 \times 10^{-4}$ | | 0.15 |
| DHB | $[Si(Pc)O]DHB_{0.19n}$ | $3.8 \times 10^{-5}$ | | 0.19 |
| DDQ | $Ni(Pc)DDQ_{0.13}$ | $2.5 \times 10^{-7}$ | | 0.43 |
| ClA | $Ni(Pc)ClA_{0.91}$ | $8.4 \times 10^{-7}$ | | 0.16 |

**van der Pauw method.

It can be seen from Table 1that the presence of dopants provides increased conductivity.

A lubricating composition of the present invention is prepared by mixing the lubricant with the doped additive. A suitable proportion is about 90 to about 99% (all percentages herein are by weight based as total composition weight) of the lubricant and about 1 to about 10% of the additive, and a preferred composition is about 95 to about 97% of the lubricant and about 3 to about 5% of the additive. If too much additive is used, the lubricating composition may bind, and there is no additional benefit to the use of excess additive. On the other hand, if too little additive is used, the life of the bearing will not be extended as much.

The lubricating composition of this invention can be used with any type of rolling or journal bearing, including ball bearings, roller bearings, and other types of bearings such as linear bearings. It is particularly useful with steel bearings, such as 52100 steel bearings, and may be used with stainless steel bearings as they are corrosion resistant and are more likely to be used in high-temperature, high-speed applications. However, the composition can also be used with plastic bearings and ceramic bearings, as well as with other types of bearings. The lubricating composition is particularly useful with bearings operating at temperatures between 130° F. and 600° F. in oxidizing atmospheres or in excess of 500° F. in vacuum or inert environments, as it is under those conditions that the advantages of this invention in extending the life of ball, roller or journal bearings are most obvious. For the same reason, bearings that are operated at a DN (diameter in millimeters times speed in rpm) greater than 300,000 will also benefit from the use of the lubricating compositions of this invention.

The present invention discloses a polymeric phthalocyanine complex that may be used as an additive in lubricants to increase time to failure on main shaft bearings. The preferred polymeric phthalocyanine complex may be doped to provide a conductive lubricant.

Whereas particular embodiments of the invention have been described above for purposes of illustration, it will be appreciated by those skilled in the art that numerous variations of the details may be made without departing from the invention as described in the appended claims.

We claim:

1. A lubricating composition comprising:

(a) about 90 to about 99 weight percent of a lubricant; and (b) about 1 to about 10 weight percent of a doped polymeric organometallic phthalocyanine complex, and nitrogen-substituted analogues thereof, wherein the dopant is selected from the group consisting of $AsF_5$, $I_2$, $Br_2$, $H_2SO_4$, $HClO_4$, $NOSbF_6$, $SbF_5$, Na, K, Li and $LiAlH_4$, the metal ion in said complex being of a Group IVA metal.

2. A composition according to claim 1 wherein the metal ion in the polymeric organometallic phthalocyanine complex is a Group IVA metal.

3. A composition according to claim 1 wherein the organometallic phthalocyanine complex has the general formula

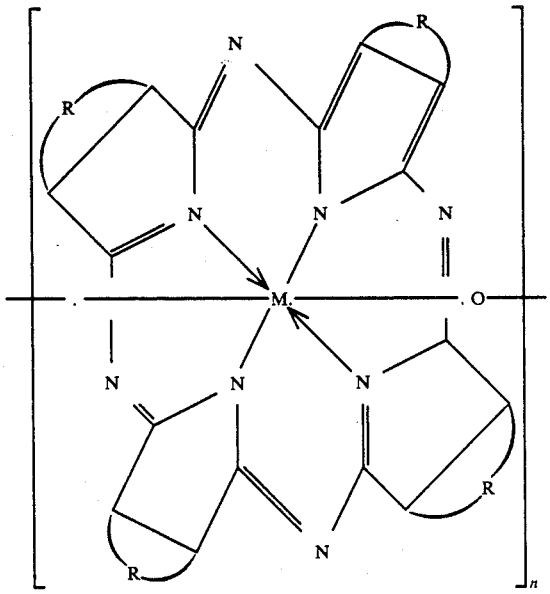

where each M is independently selected from the group consisting of silicon, germanium, and tin, R is a divalent organic group, and n is about 10 to about 200, and each R Group is independently selected from the group consisting of

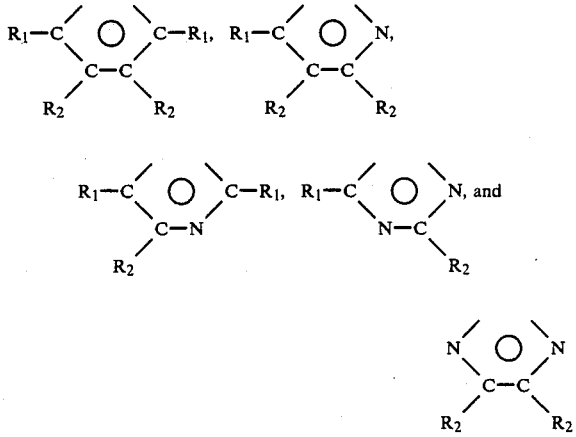

where each $R_1$ or $R_2$ may be either organic or inorganic, and is independently selected from hydrogen; esters; alkali metals; alkaline earth metals; sulfates; carboxylates; alcohols; ethers; amines; aromatic groups selected from the group consisting of phenyls, substituted phenyls, phenoxy, cumyl phenoxy, biphenyls; sulfonates; sulfonamides, having a formula $—SO_2NHR_3$, where $R_3$ is independently selected from hydrogen, $C_6H_4SO_3H$, and 2-hydroxy-6-sulfo-1-naphthyl; cyanates; halogenated groups; groups selected from the group consisting of alkyls having carbon length of 1 to 4, t-butyl groups, and alkylenes having carbon length of 1 to 4; linear and branched nitrates; carboxylic 1–4, acids; and cyclic substituents of carbon length of 1 to 10.

4. A composition according to claim 3 wherein each M is silicon.

5. A composition according to claim 3 wherein each M is zirconium.

6. A composition according to claim 3 wherein each M is tin.

7. A composition according to claim 4 wherein each $R_1$ and each $R_2$ is hydrogen.

8. A composition according to claim 1 wherein said lubricant is a synthetic lubricant.

9. A composition according to claim 1 wherein said lubricant is selected from the group consisting of perfluorethers, diesters, silicones, polyphenylethers, and mixtures thereof.

10. A composition according to claim 1 wherein said lubricant is a polymer of perfluoroalkylether.

11. A composition according to claim 1 wherein said lubricant is a petroleum-based lubricant.

12. A lubrication composition comprising:

(a) about 95 to about 97% of a synthetic lubricant selected from the group consisting of perfluoroethers, diesters, silicones, polyphenylethers, and mixtures thereof; and (b) about 3 to about 5 weight percent of a polymeric organometallic phthalocyanine complex having the general formula

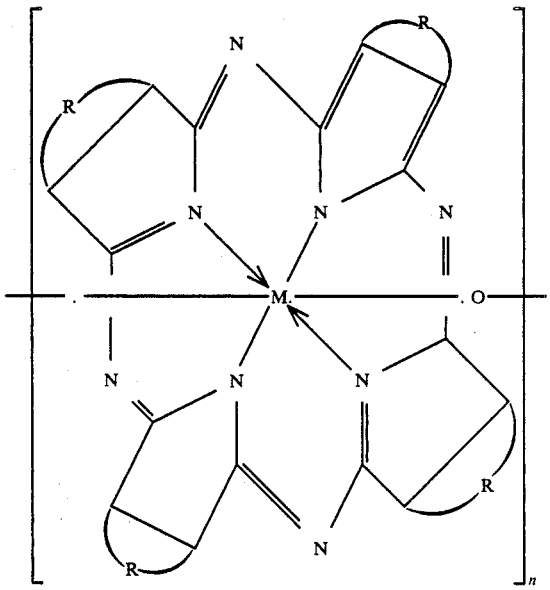

where each M is independently selected from silicon, germanium, and tin R is a divalent organic group, and n is about 10 to about 200, and where a dopant is attached to said phthalocyanine, said dopant being selected from the group consisting of $AsF_5$, $I_2$, $Br_2$, $H_2SO_4$, $HClO_4$, $NOSb_6$, $SbF_5$, Na, K, Li and $LiAlH_4$.

* * * * *